United States Patent [19]

Workman, Jr.

[11] 4,223,745

[45] Sep. 23, 1980

[54] TORQUE RESPONSIVE MOTOR SHUTOFF MECHANISM FOR FLUID OPERATED TOOL

[75] Inventor: William Workman, Jr., Spring Lake, Mich.

[73] Assignee: Cooper Industries, Inc., Houston, Tex.

[21] Appl. No.: 942,519

[22] Filed: Sep. 15, 1978

[51] Int. Cl.[3] ..... B23Q 5/06; B25B 23/145

[52] U.S. Cl. ..... 173/12; 91/59; 192/150

[58] Field of Search ..... 91/59; 173/12; 192/0.034, 150

[56] References Cited

U.S. PATENT DOCUMENTS

| | | | |
|---|---|---|---|
| 3,498,389 | 3/1970 | Tibbott | 173/12 |
| 3,616,864 | 11/1971 | Sorensen et al. | 173/12 |
| 4,078,618 | 3/1978 | Depagter et al. | 173/12 |

*Primary Examiner*—Robert Mackey

*Attorney, Agent, or Firm*—Michael E. Martin

[57] ABSTRACT

A pneumatic torque tool includes a torque responsive mechanism which actuates a valve closure member by release of an elongated actuating rod. A movable valve seat is biased in a first position by pressure fluid supplied to the tool and upon release of the actuating rod the valve closure member engages the seat to shut off air flow to the tool motor. Upon closure of an operator actuated valve the seat is biased to a second position for resetting the actuating rod and closure member.

4 Claims, 3 Drawing Figures

TORQUE RESPONSIVE MOTOR SHUTOFF MECHANISM FOR FLUID OPERATED TOOL

BACKGROUND OF THE INVENTION

In the art of pneumatic tools for tightening threaded fasteners there have been several inventions concerning mechanisms which are operable upon sensing a predetermined torque transmitted by the tool drive mechanism to actuate a motive fluid shutoff valve through an actuating member interconnecting the torque sensing mechanism and the shutoff valve closure member. Prior art devices such as, for example, disclosed in U.S. Pat. Nos. 3,616,864 and 4,078,618 assigned to the assignee of the present invention, have been adapted for use with tools known in the art as "push-to-start" types wherein an operator applied force on the tool proper opens the shutoff valve when the fastener is engaged by the tool. Accordingly, prior art devices of the general type to which the present invention pertains have not been adaptable to tools which are not of the so-called "push-to-start" type.

SUMMARY OF THE INVENTION

The present invention provides an improvement in torque responsive motor shutoff mechanisms for power tools wherein a mechanism designed for push-to-start type tools may be adapted to be used with tools having right angle drive mechanisms as well as other types of tools.

The present invention also provides an improved torque responsive motor shutoff mechanism for fluid operated tools for tightening threaded fasteners and the like wherein a motive fluid shutoff valve may be reset on termination of the tool operating cycle by a fluid actuated movable valve seat.

The present invention further provides a motive fluid shutoff valve for a fluid operated tool which requires a predetermined minimum fluid pressure to open to commence the operating cycle of the tool and to remain open during the operation of the tool.

The advantages and superior features of the present invention will be further appreciated by those skilled in the art upon reading the detailed description hereinbelow.

DESCRIPTION OF THE PREFERRED EMBODIMENT

Figure 1:
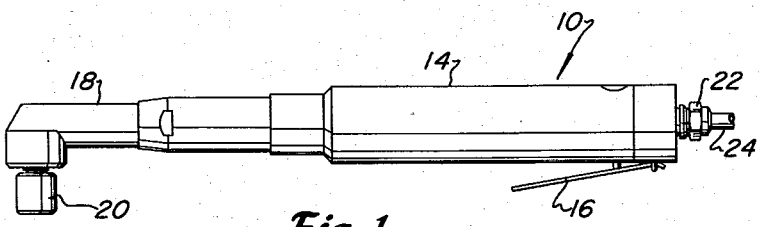
FIG. 1 is a longitudinal side elevation of a portable pneumatic nutsetter which includes the torque responsive motor shutoff mechanism of the present invention.

Referring to FIG. 1, a portable pneumatic tool comprising a wrench or nutsetter is shown and generally designated by the numeral 10. The tool 10 is of a type generally known and is characterized by a housing 14 and an actuating lever 16 for opening a motive fluid supply valve to be described hereinbelow. The tool 10 is provided with a right angle final drive mechanism which is disposed in the housing portion 18 and which is adapted to rotatably drive a fastener engaging socket member 20.

The tool 10 also includes a connector 22 attached to the housing 14 and adapted to connect a fluid supply hose 24 to the tool.

Figure 2:
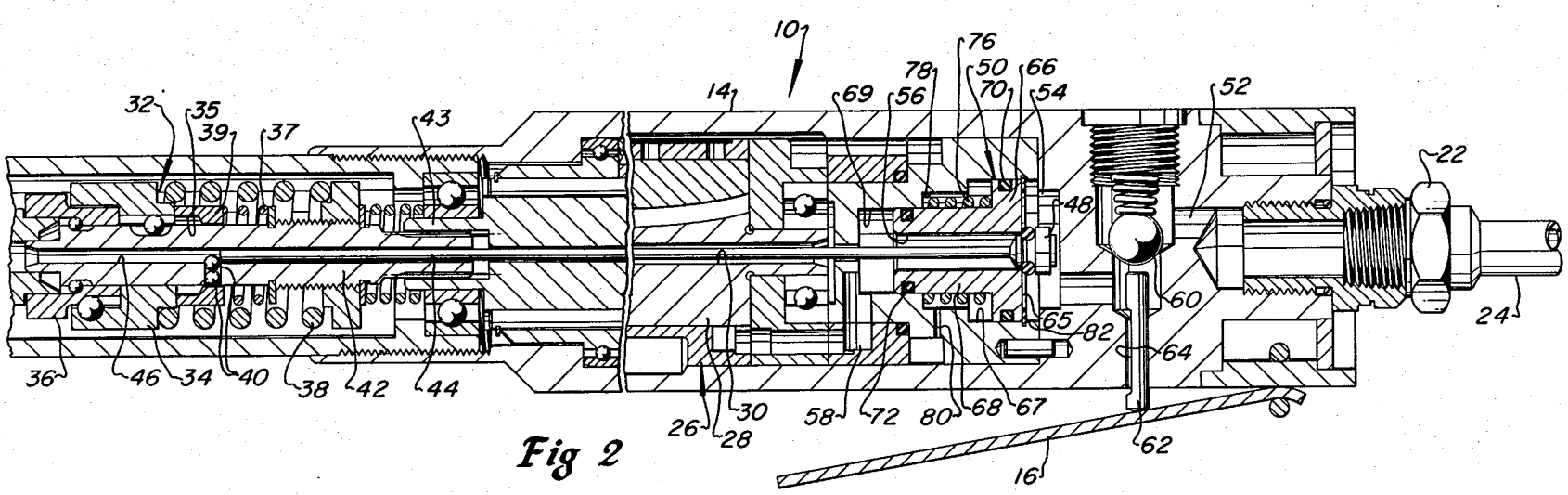
FIG. 2 is a longitudinal side elevation in section of portions of the tool shown in FIG. 1; and, FIG. 3 is a view similar to FIG. 2 showing the positions of the motor shutoff valves when the tool is running.

Referring to FIG. 2, the tool 10 further includes a rotary fluid operated motor 26 disposed in the housing 14 and including a rotor member 28 provided with a longitudinal bore 30. The rotor 28 is drivably connected to the aforementioned socket member 20 by way of suitable drive means including a torque sensing mechanism 32. The mechanism 32 is similar to the type disclosed in U.S. Pat. Nos. 3,616,864 and 4,078,618 and includes interengaged driving and driven members 34 and 36. In the interest of conciseness, details of the structural and functional aspects of the mechanism 32 may be obtained by referring to the aforementioned patents. In response to a predetermined torque transmitted from the driving member 34 to the driven member 36 the driving member moves axially against the bias of a spring 38 to move a tubular sleeve 39 to permit radial outward displacement of one or more balls 40 which are fitted in a radial bore in a rotatable drive shaft 42. The sleeve 39 is biased into engagement with the member 34 by a spring 37. The shaft 42 is suitably connected to the motor rotor 28 by intermediate drive means including the member 43. The shaft 42 is nonrotatable with respect to the driving member 34.

In the condition of the tool 10 shown in FIG. 2 the balls 40 are adapted to engage one end of an elongated actuating rod 44 which is disposed in the bore 30, extends into a bore 46 in the shaft 42 and is connected at its other end to a motive fluid shutoff valve closure member 48. When a predetermined torque is sensed by the mechanism 32 the member 34 and the sleeve 39 move axially on the shaft 42 to allow the balls 40 to be displaced radially outward to permit movement of the rod 44 whereby the closure member 48 may move into engagement with a movable valve seat 50 to effect shutoff of the motive fluid supply to the motor 26.

Motive fluid such as compressed air is supplied to the motor 26 by way of passage means 52, a cavity 54, a longitudinal passage 56 in the valve seat 50 and further passage means 58. An operator controlled valve 60 is interposed in the passage means 52 and is adapted to be engaged by a stem 62 which is engaged with the lever 16. The stem 62 includes a groove 64 which provides for venting the cavity 54 to the exterior of the tool when the valve 60 is closed as shown in FIG. 2.

The movable seat 50 includes a piston portion 66 and a reduced diameter stem portion 68, both portions being closely fitted in cooperating bores 67 and 69 in the housing 14. Suitable fluid seal elements such as o-rings 70 and 72 are disposed on the piston and stem portions, respectively. The seat 50 is biased toward the closure member 48 by a coil spring 76 disposed in a chamber 78 which is vented to the exterior of the tool through a passage 80. The seat 50 is retained in the bore 67 by a removable retaining ring 82.

Figure 3:
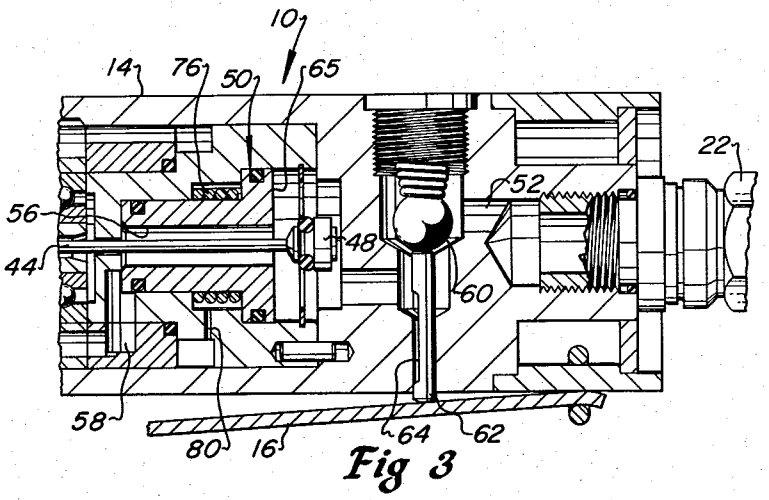

Prior to commencing an operating cycle of the tool 10, the valve 60 as well as the seat 50, the rod 44, and the closure member 48 are in the respective positions shown in FIG. 2. When the tool operator depresses the lever 16 to the position shown in FIG. 3, pressure air is admitted to the cavity 54 to act on the face 65 of the piston 66. If the pressure is sufficient to overcome the biasing force of spring 76, the seat 50 is moved to the position shown in FIG. 3 while the closure member 48 remains in a fixed position. Pressure air then flows through the passages 56 and 58 to the tool motor 26. When a predetermined torque, commensurate with the final torque to be exerted on a fastener, is sensed by the mechanism 32, the member 34 and the sleeve 39 move axially to allow the balls 40 to be displaced radially outwardly into an internal recess 35 in the sleeve whereby the rod 44 and closure member 48 are free to move to a position where the closure member reengages the seat 50 thereby closing off pressure air flow to passage 56 and the motor. When the valve closure member 48 is in the position shown in FIG. 3, there is normally a slight pressure drop across the orifice formed between the closure member and the seat so that a resultant pressure force biases the closure member toward the seat and is sufficient to move the closure member to engage the seat when the mechanism 32 releases the rod 44.

When the motor 26 is shut off by closure of the valve formed by the seat 50 and closure member 48 the operator releases the lever 16 allowing the valve 60 and stem 62 to return to their respective positions shown in FIG. 2. The cavity 54 is then vented to the exterior of the tool through the groove 64 in the stem and the reduction in pressure in the cavity allows the spring 76 to reposition the seat 50 and the closure member 48 to the position shown in FIG. 2 whereby another tool operating cycle may be commenced by the operator at will.

The arrangement of the movable valve seat 50 not only provides for an improved motor shutoff control but also may function as a minimum pressure valve. That is, if the motive fluid supply pressure is insufficient to move the seat to the position shown in FIG. 3 then pressure fluid will not be admitted to start the motor and a tool operating cycle may not be commenced if the fluid supply pressure is insufficient for the desired tool operation.

What I claim is:

1. In a fluid operated tool:

a housing;

a fluid operated motor disposed in said housing for driving a fastener engaging member;

passage means in said housing for conducting pressure fluid to said motor;

an operator actuated motive fluid supply valve interposed in said passage means;

a torque sensing mechanism drivenly connected to said motor; and, a motive fluid shutoff valve interposed in said passage means between said supply valve and said motor, and operable to be in a valve closed condition to prevent flow of motive fluid to said motor and a valve open condition to permit flow of motive fluid to said motor when said supply valve is opened, said shutoff valve including a movable closure member and a movable seat;

means interconnecting said closure member and said torque sensing mechanism for holding said closure member in a first closure member position and for allowing said closure member to move to a second closure member position in response to a predetermined torque exerted on said torque sensing mechanism, said seat including means for moving said seat to a first seat position in response to the admission of pressure fluid to said passage means to permit the flow of pressure fluid to said motor when said closure member is in said first closure member position, said closure member being operable in response to a predetermined torque exerted on said torque sensing mechanism to move to said second closure member position to engage said seat to shut off motive fluid flow to said motor, and means for causing said seat to move said closure member to said first closure member position upon closure of said supply valve.

2. The invention set forth in claim 1 wherein:

said means for moving said seat to said first seat position comprises a piston face on said seat facing a cavity in said housing comprising a part of said passage means.

3. The invention set forth in claim 1 wherein:

said means for causing said seat to move said closure member comprises a spring engaged with said seat and operable to bias said seat in engagement with said closure member toward said first closure member position.

4. The invention set forth in claim 3 together with:

vent means associated with said supply valve and operable in response to closing of said supply valve to vent said cavity whereby said spring is operable to cause said seat to move said closure member to said first closure member position.

* * * * *